US005358393A

United States Patent [19]

Kuhn

[11] Patent Number: 5,358,393

[45] Date of Patent: Oct. 25, 1994

[54] INTERNAL AXIS SINGLE-ROTATION MACHINE

[75] Inventor: Peter Kuhn, Weinheim, Fed. Rep. of Germany

[73] Assignee: The Wankel Technische Forschung-und Entwicklungsstelle Lindau GmbH, Lindau, Fed. Rep. of Germany

[21] Appl. No.: 40,636

[22] Filed: Mar. 31, 1993

[30] Foreign Application Priority Data

Apr. 1, 1992 [CH] Switzerland ..... 01 048/92-0

[51] Int. Cl.[5] ..... F01C 1/10

[52] U.S. Cl. ..... 418/168; 418/150

[58] Field of Search ..... 418/168, 166, 164, 150, 418/152

[56] References Cited

U.S. PATENT DOCUMENTS

| | | | |
|---|---|---|---|
| 1,753,476 | 8/1930 | Richer | 418/168 |
| 4,764,098 | 8/1988 | Iwase et al. | 418/152 |
| 5,011,389 | 4/1991 | Timuska | 418/152 |

FOREIGN PATENT DOCUMENTS

| | | | |
|---|---|---|---|
| 3715597 | 1/1989 | Fed. Rep. of Germany | 418/168 |
| 3916858 | 11/1990 | Fed. Rep. of Germany | 418/168 |

*Primary Examiner*—Richard A. Bertsch
*Assistant Examiner*—Charles G. Freay
*Attorney, Agent, or Firm*—Ladas & Parry

[57] ABSTRACT

The radial cross sections of the three engagement parts of the external rotor of an internal axis single-rotation machine are defined by outer and inner circular arcs. The shape of the internal rotor, having two engagement parts, is kinematically precisely adapted to the external rotor. In order that the internal rotor can be easily manufactured with high shape accuracy, that the machine be given a good volumetric efficiency, and that a good seal be obtained between the rotors, even in the case of high rotational speeds, the center of the circle containing the arcs of the inner faces of the engagement parts of the external rotor has a spacing from the rotational axis of the external rotor of at least approximately 9 times the amount of the eccentricity between the two rotors, and the radius of the external rotor inner faces is about to 7 to 7.5 times this eccentricity.

2 Claims, 3 Drawing Sheets

INTERNAL AXIS SINGLE-ROTATION MACHINE

BACKGROUND OF THE INVENTION

The invention relates to an internal axis, single-rotation machine, with an external rotor and an internal rotor sealingly enclosed by a common housing, which rotate in a speed ratio of 2:3 about axes having a constant eccentricity, relative to each other (i.e., a constant distance between the axes of external and internal rotors) so that the external rotor has three engagement parts with a radial width corresponding to twice the eccentricity and the internal rotor two engagement parts, the internal rotor and the external rotor being in permanent reciprocal engagement during rotation.

A constant mutual engagement is necessary in order to obtain a satisfactory efficiency of such a single-rotation machine. However, this means that both rotors approach at the engagement points only up to a very narrow spacing forming a sealing gap. A direct engagement contact would lead to rotor damage in the case of the high rotational speeds sought for gas feed purposes. The minimum possible width of the sealing gap at the engagement points is determined by the precision of manufacture of the rotors and the accuracy of their installation.

The kinematically exact shape of the rotor parts coming into mutual engagement necessary for a minimum sealing gap width can only be manufactured with considerable effort and expenditure in the case of known single-rotation machines of this type. A machine of the aforementioned type, which is characterized by a particularly good volumetric efficiency is known from EP-A-167 846 (Wankel).

In order to reduce the manufacturing costs U.S. Pat. No. 1,753,476 (Richer) proposes making the inner face of the engagement parts of the external rotor arcuate and the internal rotor ring-shaped, i.e. bounded by two circular arcs and two straight lines. As a result of this shaping it is not possible to obtain a precise kinematic shape of the rotors, so that due to intermittent mutual engagement of the rotors or varying and excessive engagement gaps, it would only be appropriate for use in connection with machines for feeding liquid media and having correspondingly low speeds. Such a shape would correspond to a spacing of the center of the circle of the arc of the external rotor from its center corresponding to eight times the eccentricity and with a radius of curvature corresponding to six times the eccentricity.

SUMMARY OF THE INVENTION

The problem of the invention is to find a single-piston machine of the aforementioned type which, in the case of an easily manufacturable shape of its rotors, has a good volumetric efficiency and which is in particular suitable for gas feeding at high rotational speeds. According to the invention, this problem is solved by a single-rotation machine of the aforementioned type, wherein the radial cross-sections of the engagement parts of the external rotor are defined by two circular arcs, the centre of the circle of the inner face of the engagement parts having a spacing from its geometrical rotation axis which corresponds, at least approximately, to nine times the eccentricity and in which its radius is equal to 7 to 7.5 times the eccentricity.

As a result of the aforementioned uninterrupted, sealing gap-forming engagement of the external rotor with the internal rotor, the shape of the internal rotor is kinematically determined by the envelope curve.

As a result of the inventively essential features, there is a shape for both rotors which can be easily manufactured, which leads to a relatively high feed volume, which brings about an engagement adaptation between the engagement parts aiding the sealing action and, as a result of which, the engagement parts of the external rotor loaded by centrifugal bending forces have a good stiffness, so that narrow sealing gaps are possible. Therefore such a single-rotation machine is suitable in the case of good efficiency for high gas feed capacities.

DESCRIPTION OF THE DRAWINGS

The invention is described in greater detail hereinafter relative to the drawing, which show.

DETAILED DESCRIPTION OF AN EMBODIMENT

Figure 1:
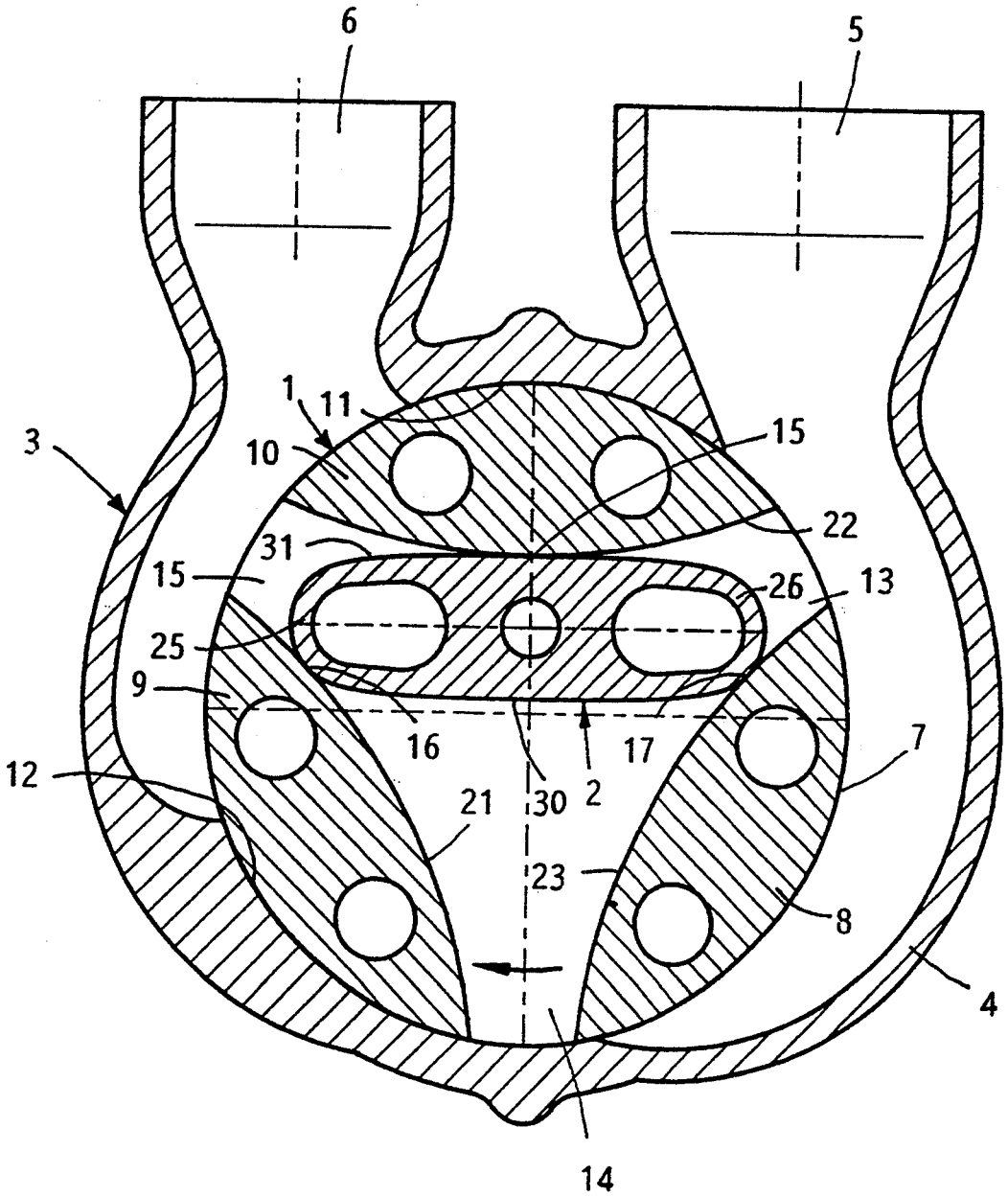
FIG. 1 A radial section through a single-rotation machine according to the invention.

The external rotor 1 and the internal rotor 2 of the single-rotation machine 3 are surrounded by a common housing 4, on which are located two connections 5, 6 for the suction and blowing out of a gaseous medium. The external rotor 1 moves on two diametrically facing, arcuate inner faces 11, 12 of the housing having a limited, sealing gap-forming spacing with respect to the arcuate outer faces 7 of its three engagement parts 8, 9, 10. Since the engagement spaces 13, 14, 15 are only opened to the outside in the vicinity of the blow-off connection 6, such a single-rotation machine 3 operates with an internal seal, i.e. it does not have to constantly deliver against a counterpressure in the outflow channel.

Figure 2:
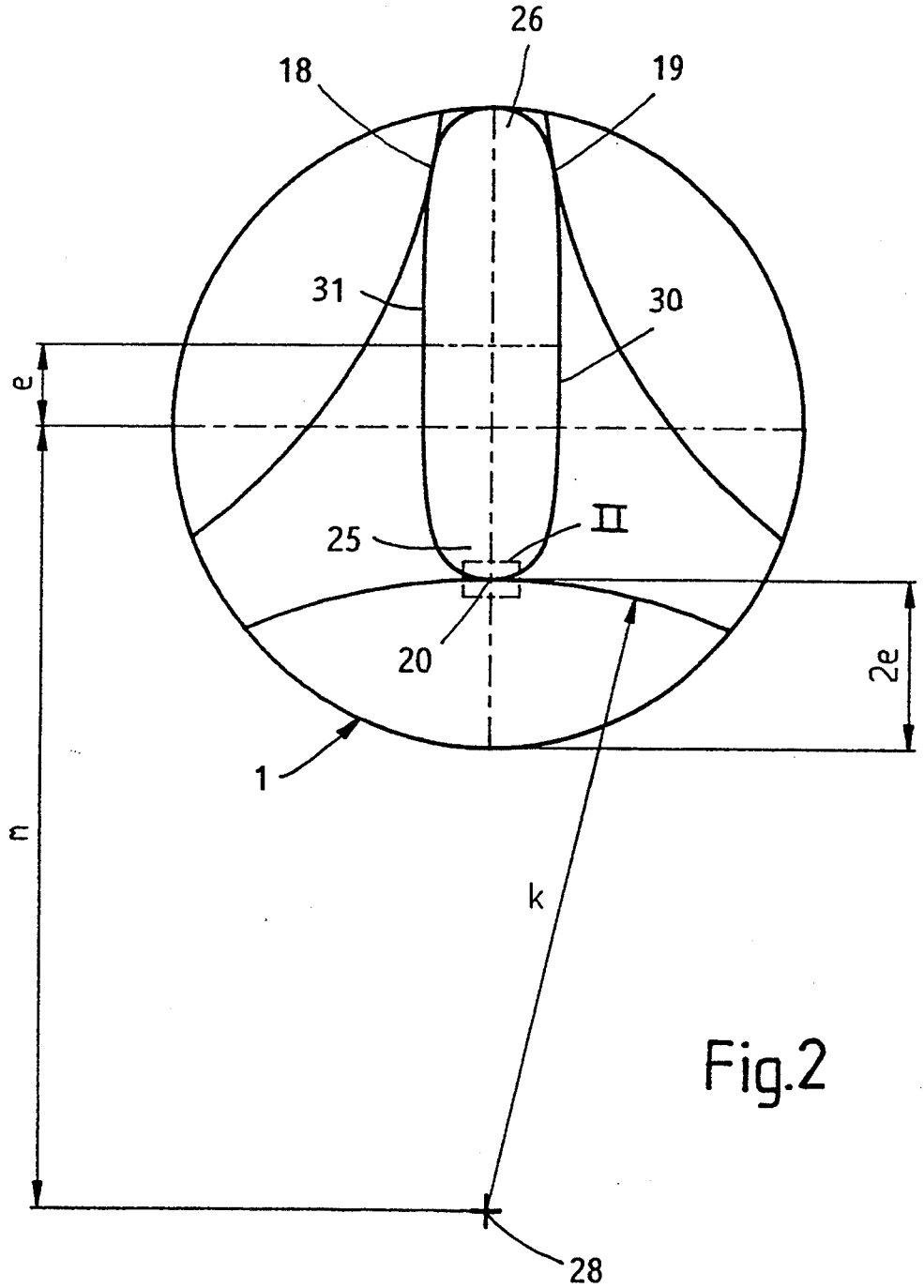
FIG. 2 A view of the rotors of the single-rotation machine according to FIG. 1 in a different rotation position.
Figure 3:
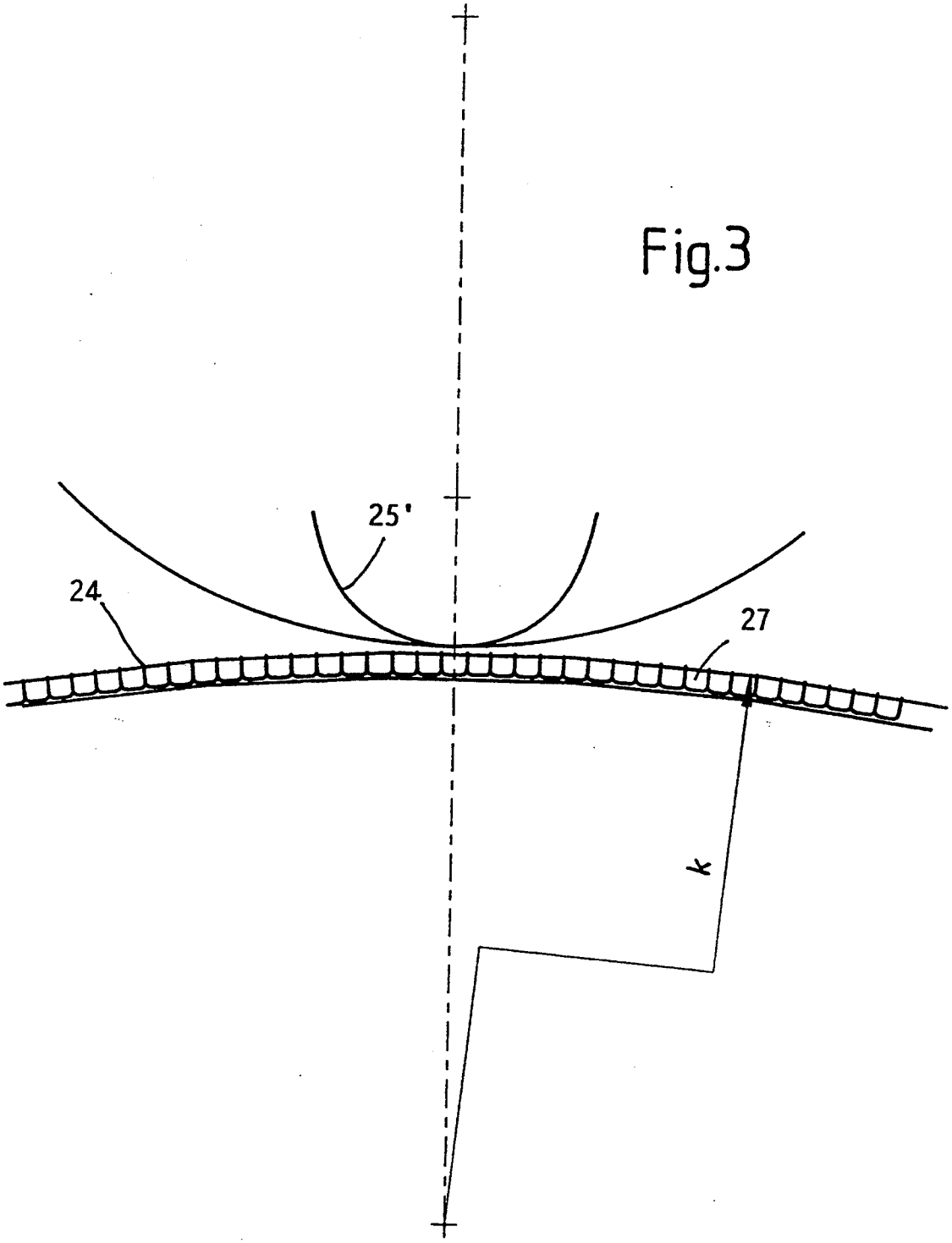
FIG. 3 A larger scale representation of area II of FIG. 2, with part of the contour of two differently shaped internal rotors.

As a result of their kinematically adapted shape, the two rotors 1, 2 are in sealing gap-forming, mutual engagement in three areas 15, 16, 17 or 18, 19, 20 (FIG. 2). This contact-free engagement is ensured by a drive connection between the two rotors 1, 2 by means of external gears (not shown). In order to obtain a good efficiency, the sealing gap width should be as small as possible, but without any contact taking place. Preferably, the inner faces 21, 22, 23 of the engagement parts 8, 9, 10 of the external rotor 1 are provided with a porous plastic layer 24, so that the sealing gaps can be automatically worked to a minimum by abrasion. This minimum is determined by the precision of the shaping of the rotors, their mounting and their driving coupling. In addition, the quality of the gap seal is determined by the degree of adaptation of the interengaging surface areas of the rotors 1, 2. This is illustrated in the larger scale view of FIG. 3. In the case of a smaller average radius of the engagement parts 25, 26 of the internal rotor and correspondingly poor adaptation, the length of the gap space towards the pressure reduction is shorter, which is illustrated by the strongly curved profile curve 25'. The pressure reduction occurs when using the porous plastic layer 24, as a result of its open pores 27 following running in, in the manner of a labyrinth packing.

Thus, for an optimum shaping of the rotors 1 2, it is necessary to seek a maximum average radius of curvature of the engagement parts 25, 26 of the internal rotor. In addition, the engagement parts 8, 9, 10 of the external rotor 1 must have an adequate width in the radial direction to avoid their deformation by centrifugal forces. In addition, the shaping of the rotors 1, 2 must provide between them a maximum feed space, which is obtained in the relative rotation position on the engagement space 14 shown in FIG. 1. Finally, the rotors must have an advantageous convex shape for economical manufacture. These conditions are fulfilled in optimum manner if the spacing designated m in FIG. 2 i.e. the distance from the center of the circle 28 of the arc of the inner faces 21, 22, 23 of the external rotor 1 to the center of external rotor 1, corresponds to at least 9 times the eccentricity e between the axis of internal rotor 2 and the axis of external rotor 1, and also if the radius k of said arcs is 7 to 7.5 times the eccentricity e.

The higher values for k are preferably selected for particularly rapidly rotating rotors 1, 2, so that centrifugal bending is low. With more slowly rotating rotors preference is given to the lower value k in this range corresponding to at least approximately 7, so that the adaptation between the rotors is even better.

As a result of the value m being greater than 9, it is ensured that also the long lateral faces 30, 31 of the internal rotor 2 have no concave areas, which would make it more difficult to work the surface by contour grinding. For a large maximum feed space between the rotors 1, 2 or for a good volumetric efficiency, the value for m should not significantly exceed 9, so that the lateral faces 30, 31 have a very slightly convex shape or only differ slightly from a straight line, as shown in the embodiment. A value of $m=10$ should not be exceeded.

The curvature of the two end areas 25, 26 of the internal rotor 2 is obtained by kinematic generation, diverging from the arcuate shape, through the arcuate inner faces 21, 22, 23 of the external rotor 1.

What is claimed is:

1. An internal axis single-rotation machine for gas feeding at high rotational speeds, comprising: an external rotor and an internal rotor sealingly enclosed by a common housing, wherein:

the external rotor and internal rotor rotate in a speed ratio of 2:3 about axes having a constant eccentricity (e) relative to each other;

the external rotor has a geometrical rotation axis and has three engagement parts each with a radial width corresponding to twice the eccentricity ($2\times e$) and each having an arcuate inner facial engagement surface; and the internal rotor has a continuous outer engagement surface defined by two engagement end portions having outer engagement surfaces and nonconcave long lateral facial engagement surfaces joining the outer engagement surfaces of the end portions, the outer engagement surface of the internal rotor and the inner facial engagement surfaces of the external rotor being in constant mutual engagement during rotation;

the radial cross-section of each of the three engagement parts of the external rotor are defined by an inner and an outer circular arc;

the center of a circle containing the inner arc of any one of said external rotor engagement parts has a spacing (m) from the geometrical rotation axis of said external rotor, (m) being at least approximately 9 times the eccentricity ($9\times e$); and the radius (k) of said circle is equal to 7 to 7.5 times the eccentricity (7 to $7.5\times e$).

2. A single-rotation machine according to claim 1, wherein the long lateral faces of the inner rotor are planar or slightly outwardly curved.

* * * * *